United States Patent [19]

Walsh et al.

[11] 4,208,777

[45] Jun. 24, 1980

[54] METHOD FOR MANUFACTURING A SPLIT ENGINE CASING FROM A CYLINDER

[75] Inventors: Thomas C. Walsh, New Britain; Peter E. Voyer, Tolland; Francis J. Wallace, Windsor, all of Conn.

[73] Assignee: United Technologies Corporation, Hartford, Conn.

[21] Appl. No.: 964,103

[22] Filed: Nov. 27, 1978

[51] Int. Cl.[2] ..... B23P 15/00

[52] U.S. Cl. ..... 29/418; 29/411; 29/156.4 R; 415/219 R

[58] Field of Search ..... 29/418, 156.4 R, 411–416; 138/159, 156, 157, 158; 415/219 R

[56] References Cited

U.S. PATENT DOCUMENTS

| | | | |
|---|---|---|---|
| 1,933,279 | 10/1933 | Quarnstrom | 138/156 |
| 2,256,221 | 9/1941 | Smith | 138/159 |
| 3,286,336 | 11/1966 | Lombardi | 29/411 |
| 3,905,085 | 9/1975 | Whiting et al. | 29/418 |
| 4,137,006 | 1/1979 | Becker | 29/156.4 R |

*Primary Examiner*—Daniel C. Crane

*Attorney, Agent, or Firm*—Norman Friedland

[57] ABSTRACT

The method of fabricating a jet engine casing into two removable halves is disclosed. The method includes turning a cylindrical blank to obtain the radial structural ribs, diametrically slotting axially the outer diameter to receive two mating flanges and boring the inside diameter to remove sufficient material to expose the inner edge of the mating flanges whereby the casing is split along the axial axis.

3 Claims, 2 Drawing Figures

METHOD FOR MANUFACTURING A SPLIT ENGINE CASING FROM A CYLINDER

BACKGROUND OF THE INVENTION

This invention relates to gas turbine engines and particularly the outer case and the method of making the same.

It has become advantageous in certain jet engine models to make the engine case into halves which not only facilitate assembly, it facilitates the maintenance of the engine. Typically the split engine case was manufactured by machining the cylindrical blank to the required dimension and then splitting the case as by sawing it axially through the center.

We have found a more satisfactory way of fabricating a split case by machining the outer diameter of a cylindrical blank, axially grooving two diametrically located slots, inserting two mating half flanges in each slot and turning the inner diameter to expose the inner edges of the flanges, thereby splitting the case.

SUMMARY OF THE INVENTION

A feature of this invention is the split case for a turbine type power plant and its construction where the outer diameter of a blank cylinder is machined, diametrically opposed axial grooves are slotted, a pair of mating flanges are fitted into the slots, joined and the inner diameter of the cylinder is turned to remove sufficient material to expose the inner edges of said mating flanges. The outer diameter of the casing can be either machined finished at the initial machining operation or it can be partially machined then and machine finished at a subsequent stage. Said construction being characterized as being simpler and less costly than other heretofore methods of making a split case.

Other features and advantages will be apparent from the specification and claims and from the accompanying drawings which illustrate an embodiment of the invention.

DESCRIPTION OF THE PREFERRED EMBODIMENT

Figure 1:
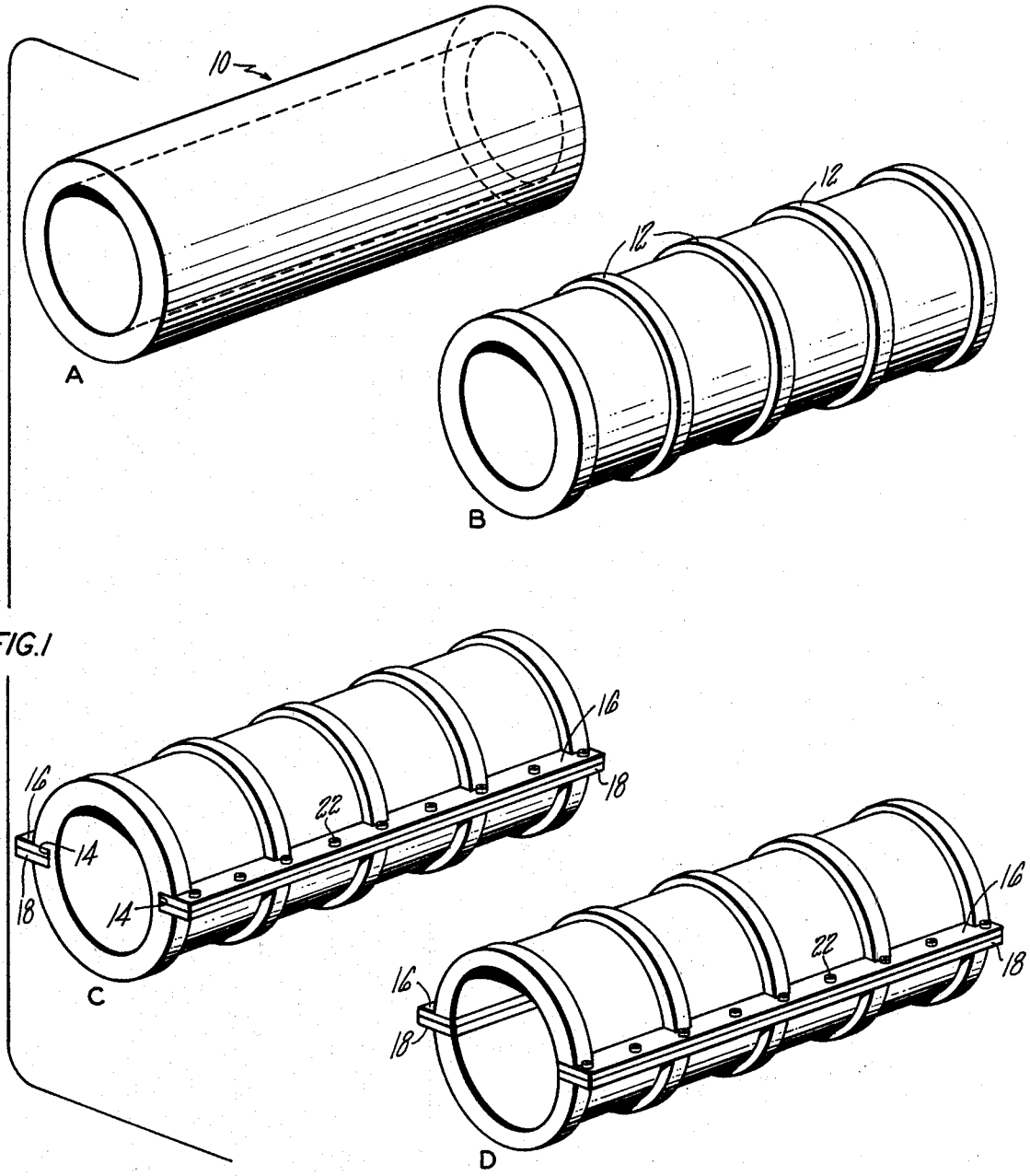
FIG. 1 illustrates in perspective the four steps (A, B, C and D) for fabricating turbine engine split case according to this invention.

The invention can best be understood by referring to the steps A, B, C and D depicted in FIG. 1 which shows the cylindrical blank 10 as being the first step in the process. The cylinder may be either a flash butt welded forging or rolled plate of a suitable high temperature resistance material, such as titanium. The outer circumference is machined as depicted by step B to incorporate radial circumferential ribs 12 for structural integrity.

As noted in step C, the outer diameter at diametric locations is slotted to define channel 14 along the axial expanse of the case and a pair of mating flanges or flat plates 16 and 18 are mounted edgewise and welded in position. A plurality of axial spaced holes 20 are drilled therein and doweled work bolts 22 are fastened therein to secure the unit in the next operation.

Figure 2:
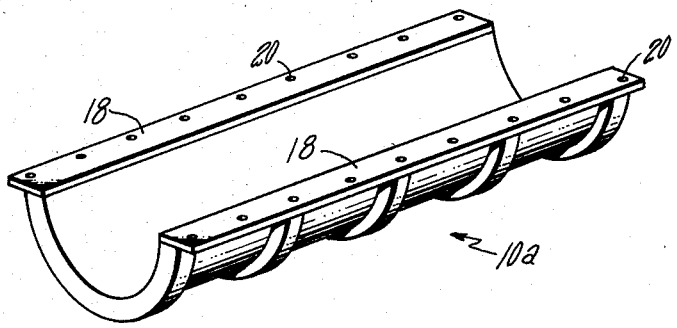
FIG. 2 is a perspective view of half of the split case.

The inner diameter in the next step of fabricating casing 10 is turned to remove sufficient metal to expose the inner edges of plates 16 and 18. From the foregoing it is apparent that the casing is split and removing the doweled work bolts 22 each half of the case is removable as depicted in FIG. 2. It may be preferable to machine finish the outer casing at this stage of the operation.

While a two piece split case is described as the preferred embodiment it may be desirable to split the case into multiple pieces and such designs are contemplated within the scope of this invention.

It should be understood that the invention is not limited to the particular embodiments shown and described herein, but that various changes and modifications may be made without departing from the spirit or scope of this novel concept as defined by the following claims.

We claim:

1. The method of fabricating a split case for a gas turbine engine including the steps of:

forming a cylinder blank;

cutting the outer diameter by turning to form circumferential, axially spaced rib-like elements;

cutting a pair of axially extending slots into the outer diameter of said cylinder with each slot being diametrically opposed to each other;

inserting two flat plate-like mating elements into said slots and each pair of flat plate-like elements extending radially from the outer diameter of the cylinder;

welding each of said plate-like elements to the cylinder; and cutting by turning the inner diameter of said cylinder to at least the inner edge of said flat plate-like elements so that the cylinder separates into two halves at the mating surface of each pair of said flat plate-like elements.

2. The method as claimed in claim 1 including the step of drilling a plurality of holes spaced axially along each pair of flat plate-like elements and securing each of the plate-like elements constituting each pair thereof prior to the step of welding.

3. The method as claimed in claim 2 wherein said cylinder is fabricated from titanium or an alloy thereof.

* * * * *